US010407240B2

(12) United States Patent
Howell

(10) Patent No.: US 10,407,240 B2
(45) Date of Patent: Sep. 10, 2019

(54) TRASH CAN SPACER

(71) Applicant: Steven R. Howell, Factoryville, PA (US)

(72) Inventor: Steven R. Howell, Factoryville, PA (US)

( * ) Notice: Subject to any disclaimer, the term of this patent is extended or adjusted under 35 U.S.C. 154(b) by 16 days.

(21) Appl. No.: 15/664,272

(22) Filed: Jul. 31, 2017

(65) Prior Publication Data

US 2018/0029794 A1 Feb. 1, 2018

Related U.S. Application Data

(60) Provisional application No. 62/369,430, filed on Aug. 1, 2016.

(51) Int. Cl.

| | |
|---|---|
| ***B65F 1/14*** | (2006.01) |
| ***B65F 1/16*** | (2006.01) |
| ***A63H 33/04*** | (2006.01) |
| ***A63H 33/06*** | (2006.01) |
| ***A63H 33/08*** | (2006.01) |

(52) U.S. Cl.

CPC ..... *B65F 1/14* (2013.01); *A63H 33/04* (2013.01); *A63H 33/044* (2013.01); *A63H 33/06* (2013.01); *A63H 33/08* (2013.01); *B65F 1/1646* (2013.01); *Y10T 428/24* (2015.01); *Y10T 428/24777* (2015.01); *Y10T 428/26* (2015.01)

(58) Field of Classification Search

CPC ..... B65F 1/14; B65F 1/1646; A63H 33/044; A63H 33/08; A63H 33/06; A63H 33/04; Y10T 428/24; Y10T 428/26; Y10T 428/24777

USPC ..... D21/484, 485, 489, 490, 491, 493, 500, D21/503, 504, 505, 506; 428/98, 192, 428/220; D8/402, 403

See application file for complete search history.

(56) References Cited

U.S. PATENT DOCUMENTS

| | | | | |
|---|---|---|---|---|
| 5,482,491 | A * | 1/1996 | Kichijyo | A63H 33/08 446/112 |
| D407,303 | S * | 3/1999 | Engberg | D8/402 |
| D503,864 | S * | 4/2005 | DiFanti | D8/402 |
| 8,061,676 | B1 * | 11/2011 | Kumar | A47C 7/62 248/346.01 |
| 2014/0302287 | A1 * | 10/2014 | Lehtonen | A45C 13/001 428/192 |

OTHER PUBLICATIONS

[NPL-1] "DIY Wood Hexagon Coasters"; May 22, 2014, <http://idlehandsawake.com/diy-wood-hexagon-coasters/>. (Year: 2014).*

(Continued)

*Primary Examiner* — David Sample
*Assistant Examiner* — Donald M Flores, Jr.
(74) *Attorney, Agent, or Firm* — Snyder, Clark, Lesch & Chung, LLP

(57) ABSTRACT

Disclosed is a universal trash can spacer, a rigid spacer of particular shape designed to rest on the floor between a flip-top trash can and the wall of a building, in order to keep the can away from the wall and prevent the open lid of the can from hitting the wall and causing damage to the wall or can lid. Since flip-top trash cans come in many sizes and shapes (square, rectangular round, oval, etc.), the spacer device may be able to accommodate any and all such cans.

13 Claims, 7 Drawing Sheets

(56) References Cited

OTHER PUBLICATIONS

[NPL-2] David Mitchell, "Squashed Hexaon Tiles"; <http://www.origamiheaven.com/pdfs/squashed.pdf>. (Year: 2016).*
[NPL-3] Snyder, D., "Using Table Saw Methods to Make Objects Having Polygonal Shapes"; Jun. 10, 2012, <http://dls-website.com/documents/WoodworkingNotes/Polygon_Notes.pdf>. (Year: 2012).*
[NPL-4] chriscudmore, "Hanging Shelves"; Jul. 31, 2012, Home Improvement Blog, <https://diy.blogoverflow.com/2012/07/hanging-shelves/>. (Year: 2012).*
[NPL-5] Wahlgren, K., "Special Delivery: Nearly 4,500 Pieces in Hexagonal End-Grain Floor". Nov. 18, 2015; <https://www.woodfloorbusiness.com/sanding-finishing/special-delivery-nearly-4-500-pieces-in-hexagonal-end-grain-floor.html>. (Year: 2015).*

* cited by examiner

TRASH CAN SPACER

CROSS REFERENCE TO RELATED APPLICATION

This application claims priority to U.S. Provisional application Ser. No. 62/369,430 filed Aug. 1, 2016 and titled Trash Can Spacer. The entire disclosure of this application is incorporated herein by reference.

BACKGROUND

Flip-top garbage cans are a great convenience to the user, allowing for the disposal of trash without having to touch the can (which is often dirty). These cans are usually operated by a foot-pedal at the bottom front of the can whereby the lid, which is connected to the foot-pedal, usually swings back on a hinge at the top rear. This manner of hinging means that the lid, which is usually several inches thick, projects several inches beyond the rear of the can when open. These cans (and trash cans in general) are normally positioned at the periphery of the room they are in, and as such are usually pressed flush against a wall or in a corner of the room. The strength of the foot operated mechanisms often causes the lid of the can to open with considerable force, such that it strikes the wall behind the can. With repeated openings, these impacts can damage the wall, either scraping off paint or actually denting walls. Correcting such damage may involve repairing any wall damage and repainting the entire wall (since small paint repairs are often highly visible against the older paint of the wall). Even if owners attempt to position the can at some distance out from the wall to prevent damage, users repeatedly stepping on the foot-pedal to open the can will normally shift the can back in a relatively small number of openings until it is again in contact with the wall, and again causing damage.

DETAILED DESCRIPTION

Those skilled in the art will recognize other detailed designs and methods that can be developed employing the teachings of the present invention. The examples provided here are illustrative and do not limit the scope of the invention, which is defined by the attached claims. The following detailed description refers to the accompanying drawings. The same reference numbers in different drawings may identify the same or similar elements.

Consistent with implementations described herein, a wall spacer for hinged top trash cans is described, comprising in an embodiment a rigid piece of flat material made of, for example, plastic, wood, rubber, metal, etc., shaped and dimensioned to fit between a commonly-sized trash can and a wall, or in the corner between two perpendicular walls and designed to keep the trash can a safe distance away from the wall or walls so that when the lid is opened, the lid does not contact the wall or walls.

The present invention is a universal trash can spacer, a rigid spacer of particular shape designed to rest on the floor between a cylindrical or rectangular flip-top trash can and the wall of a building or other vertical surface, to keep the can away from the wall and prevent the open lid of the can from hitting the wall and causing damage to the wall or can lid.

Figure 1A:
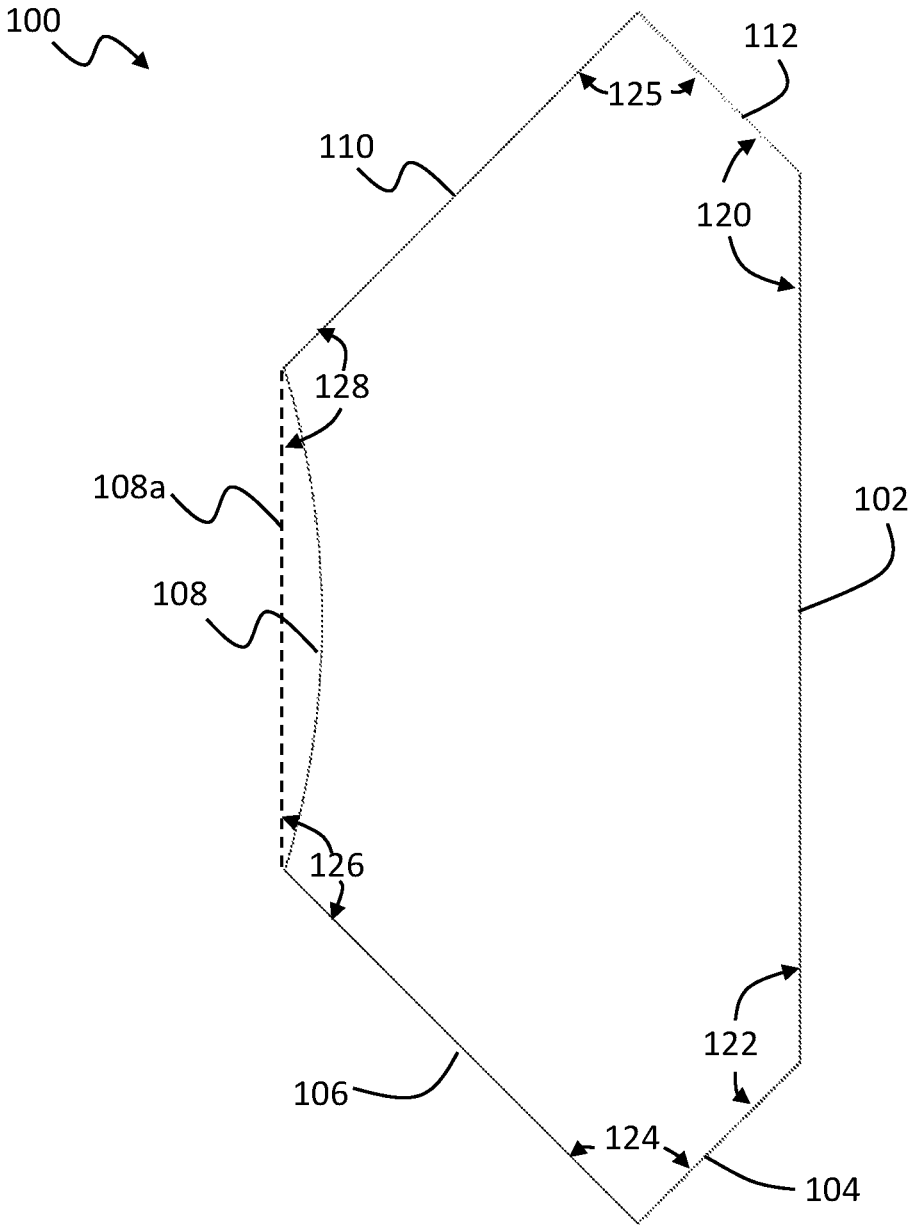
FIG. 1A is a top view of an exemplary trash can spacer.
Figure 1B:
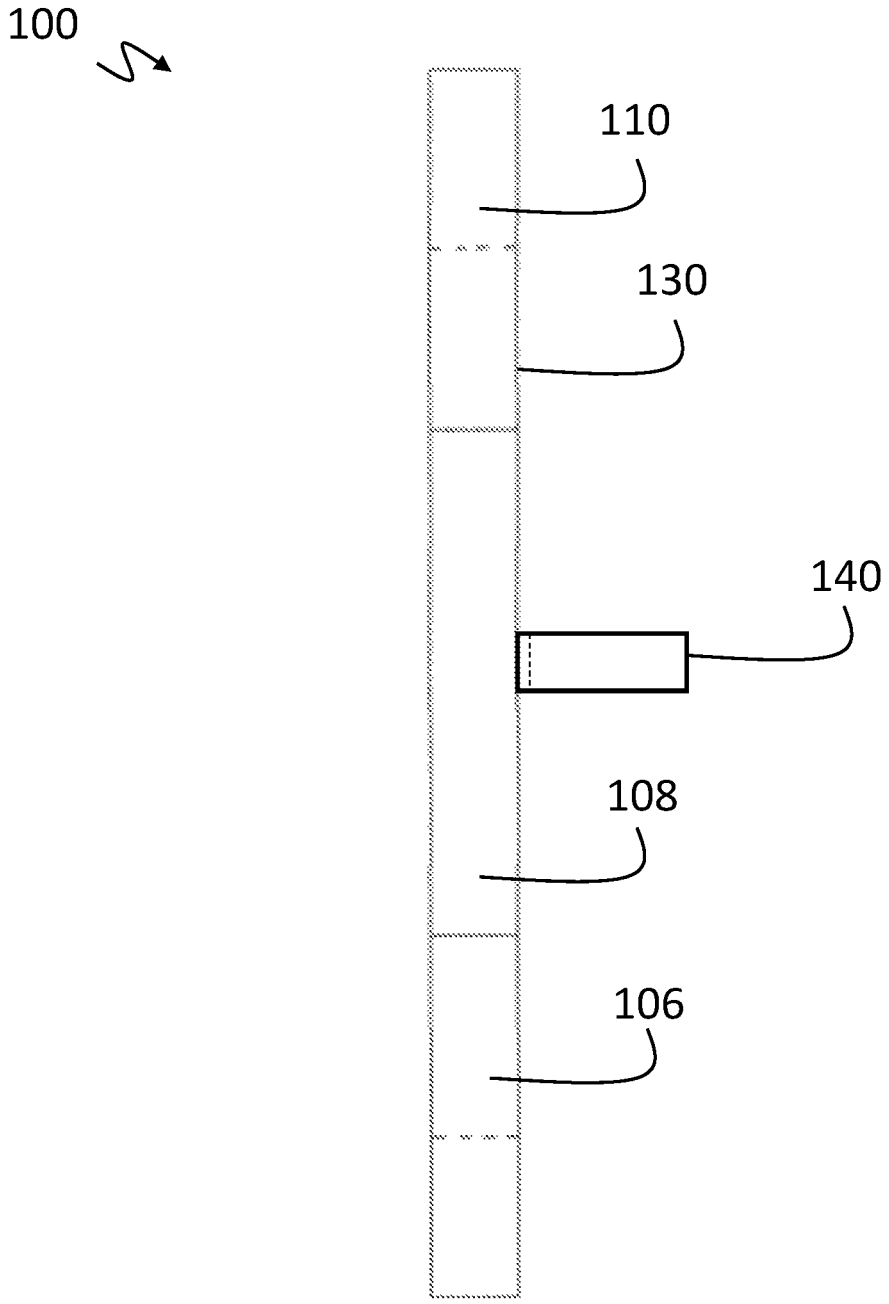
FIG. 1B is a front view of the trash can spacer of FIG. 1A.
Figure 4:
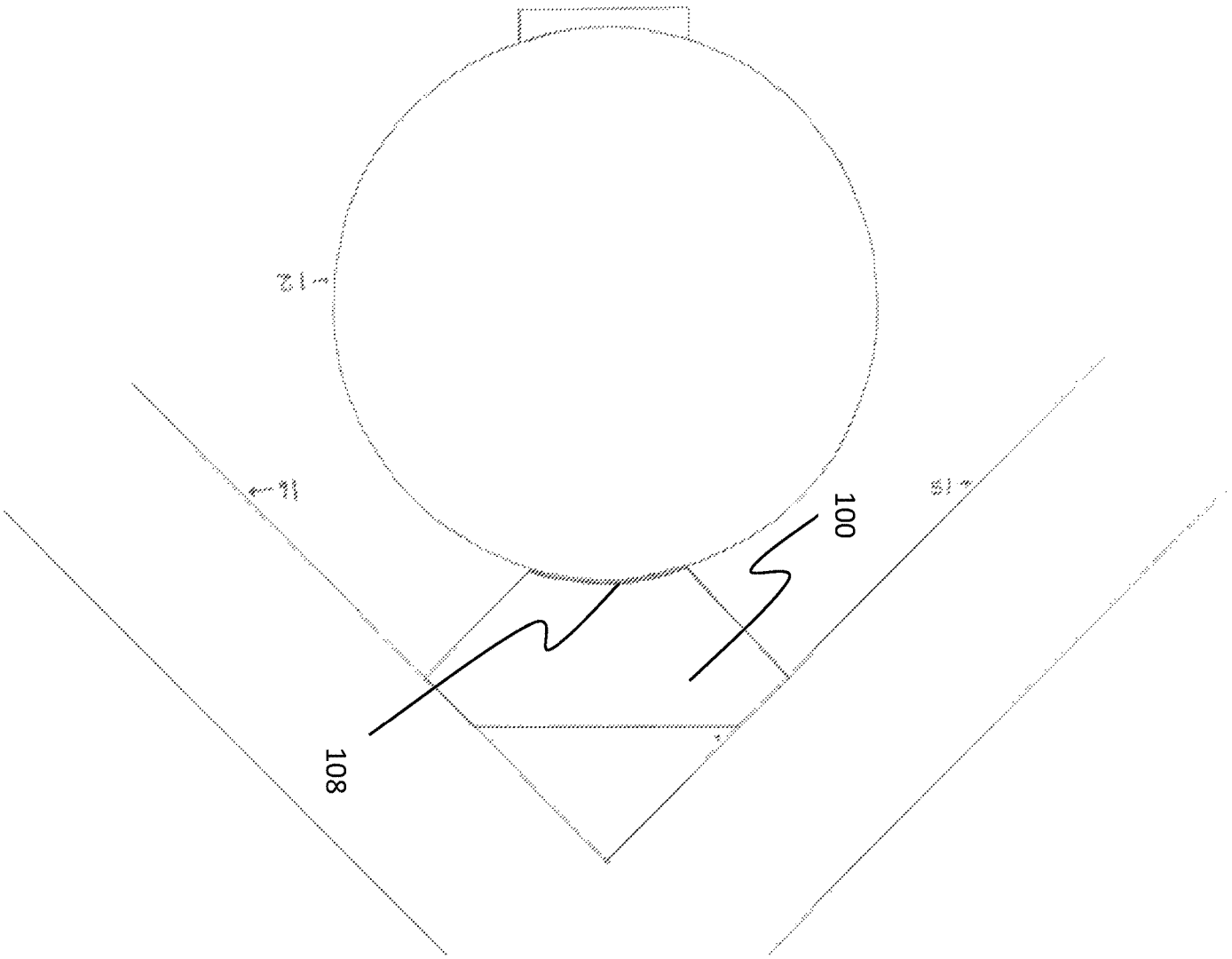
FIG. 4 shows a top view of the trash can spacer in use, with a round or oval-shaped can in a corner (two wall) installation.

FIGS. 1A and 1B are top and front views, respectively of an exemplary trash can spacer 100. In one embodiment, the spacer 100 is a six-sided flat object, with one of the sides 108 having a circular or curved shape, the diameter of which matches the largest diameter cylindrical trash can for which the spacer can practically be used. The spacer 100 has a base side 102 which is the longest of the sides. Adjacent the base side 102, are cylindrical can corner-fitting sides 104 and 112 that are both at approximately 135 degree angles to the base side (i.e., angles 120 and 122 are approximately 135 degrees). Cylindrical can corner-fitting sides 104 and 112 are offset by 90 degrees with respect to each other and are adapted to allow the spacer 100 to fit in a corner between two walls 15 and 16 with curved side 108 facing outward, as shown in FIG. 4. Adjacent each of the cylindrical can corner fitting sides 104 and 112 are rectangular can corner fitting sides 106 and 110, respectively. Rectangular can corner fitting sides 106 and 110 are at 90 degrees to cylindrical can corner fitting sides 104 and 112, respectively (i.e., angles 124 and 125 are 90 degrees). Rectangular can corner fitting sides 106 and 110 are offset by 90 degrees with respect to each other and are adapted to allow the spacer 100 to fit in a corner between two walls with flat side 102 facing outward to fit against a square or rectangular trash can back side. Curved side 108 is adjacent rectangular can corner fitting sides 106 and 110. The chord 108*a* associated with curved side 108 is at approximately 135 degree angles to each of rectangular can corner fitting sides 110 and 106 (i.e., angles 128 and 126 are 135 degrees.

The dimensions of the can spacer 100 can be varied to accommodate differently sized trash cans. In an exemplary embodiment, base side 102 is 6 inches long, circular can corner fitting sides 104 and 112 are 1.6 inches long, rectangular can corner fitting sides 106 and 110 are 3.4 inches long and curved side 108 is a portion of a 12 inch diameter circle, with the chord length between sides 110 and 106 being 3.4 inches long. This exemplary shape can be scaled up or down based on the following relationship normalized to the base side 102, where base side 102 equals S: sides 104 and 112 equal approximately 0.267 S, sides 106 and 110 equal approximately 0.567 S and curved side 108 has a diameter of approximately 2 S and lies on a chord of length of approximately 0.567 S. These dimensions can be scaled up proportionally to deal with cans with thicker lids or round cans of diameter greater than 12 inches.

The dimensions and shape are designed to yield a compact spacer that will be universal to work with square, rectangular, oval-shaped and round cans and in wall or corner installations. An exemplary spacer thickness of 0.5 to 1 inch is sufficient in exemplary embodiments.

Figure 2A:
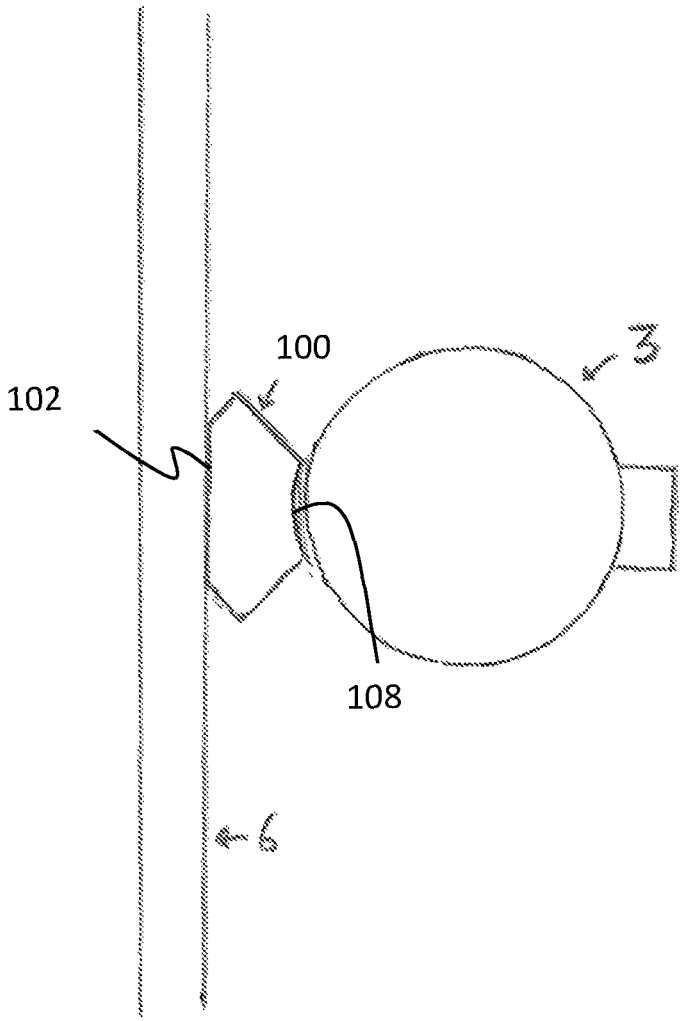
FIG. 2A shows a top view of an exemplary trash can spacer in use with a round or oval-shaped trash can in a single wall installation.
Figure 2B:
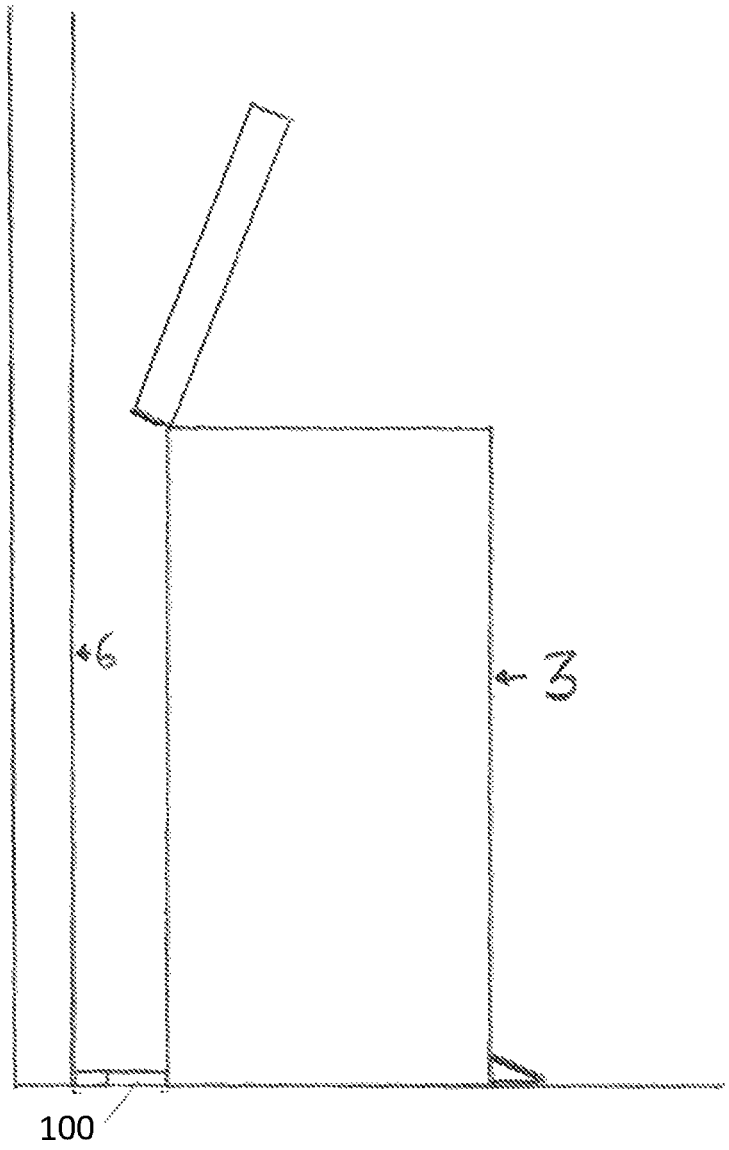
FIG. 2B shows a side view of the trash can spacer and round or oval-shaped trash can of FIG. 2A.

FIGS. 2A and 2B show an exemplary trash can spacer in use, with a round trash can 3 in a single wall 6 installation. The concave edge 108 of the spacer 100 is facing away from the wall 6 (facing the can), with the long flat edge 102 against the wall. Generous clearance is provided between the flip-top lid of the can and the wall, and the spacer will be mostly hidden by the can. While the spacer 100 is designed to work ideally with the most common cans of approximately 12 inch diameter, it will still function with 10 inch or smaller cans, or with cans of somewhat larger diameter.

Figure 3A:
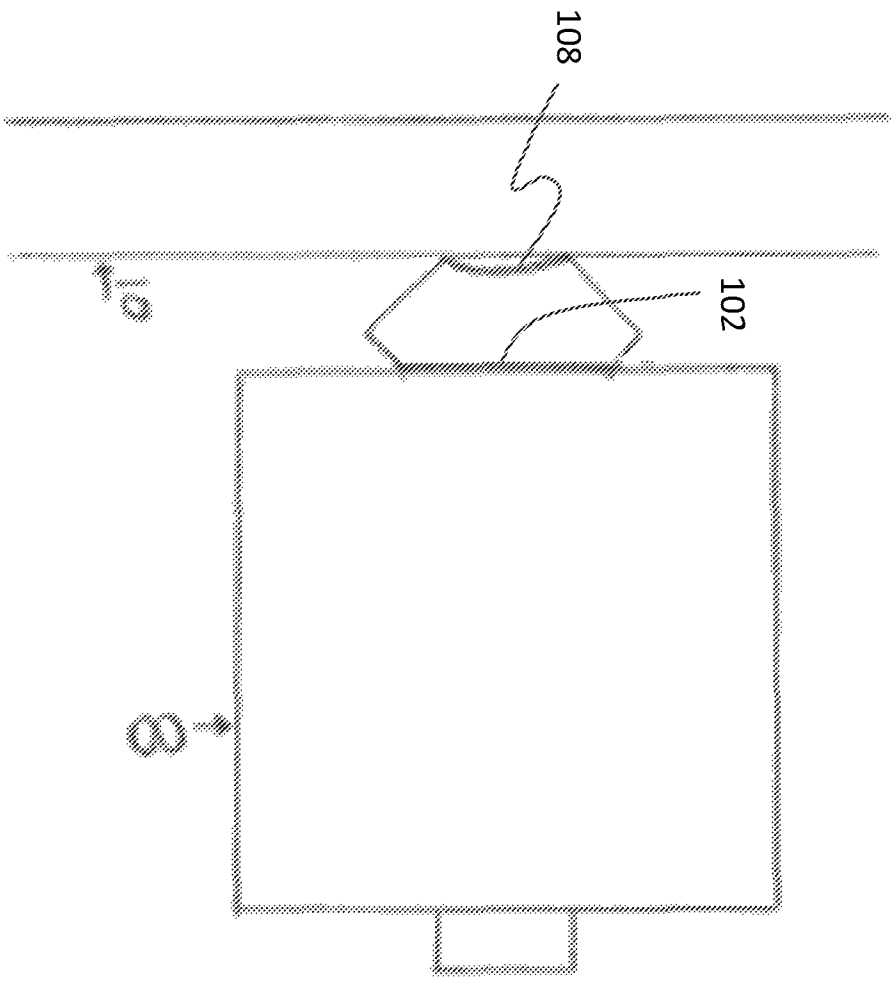
FIG. 3A shows a top view of an exemplary trash can spacer in use with a square or rectangular trash can in a single wall installation.
Figure 3B:
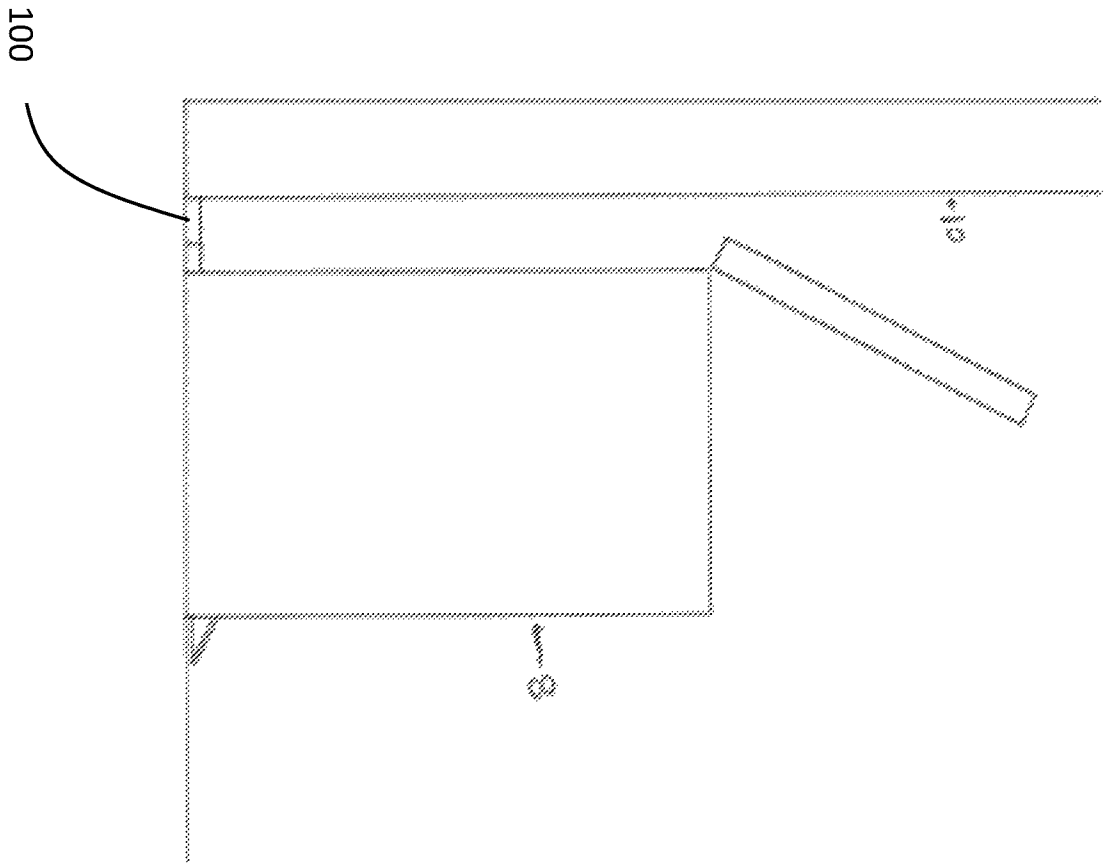
FIG. 3B shows a side view of the trash can spacer and square or rectangular trash can of FIG. 3A.

FIGS. 3A and 3B shows an exemplary trash can spacer in use, with a square or rectangular can 8 in a single wall installation. In this implementation, the concave edge 108 of the spacer faces the wall 10, with the long flat edge 102 faces the can 8. The spacer 100 will be mostly hidden by can 8, as illustrated in FIGS. 3A and 3B. A square or rectangular can of any width and depth can be used in this configuration. In some implementations, the lid of can 8 may not be greater than approximately 2 inches in thickness.

FIG. 4 shows a top view of an exemplary trash can spacer 100 in use with a round or oval shaped can 12 in a corner between wall 15 and 16. In this configuration, short sides 104 and 112 are aligned against each wall 15 and 16 that form the corner and the round can 12 is fitted into the concave edge 108 of the spacer.

Since flip-top trash cans come in many sizes and shapes (square, rectangular, round, oval, etc.) it is desirable that a single spacer device be able to accommodate any and all such cans. The particular shape of spacer 100 described herein allows spacer 100 to be used against a wall, with one side against the wall and one side against the can. To accommodate both round and square cans, one edge of spacer 100 is flat, and the other has a concave indentation (a portion of the arc of a circle or curved surface is approximately equal to the diameter of the largest can that spacer 100 will accommodate). For single-wall installations, if the can is round or oval shaped, the concave edge of spacer 100 is located against the can, and the flat edge is against the wall. If the can is square, rectangular or irregularly shaped, the square edge of spacer 100 is located against the can, with the concave edge located against the wall. In corner installations where the opening of the lid would be facing out from the corner midway between the two perpendicular walls, spacer 100 has diagonal corners such that spacer 100 fits flush against the two walls which form the corner, keeping a round can of up to 12 inches in diameter at a safe distance from both walls. Non-round cans tend to be of sufficient width that it is impractical to position them diagonally in the corner of a room, as too much wasted space will result, and in any event the size of the spacer required would be so large as to be impractical. Thus, a square or rectangular can is best placed in a single-wall orientation near a corner. In such implementations, two spacers 100 may be use, one spacer 100 located behind the can and one spacer 100 located at the side of the can, to keep the lid from striking the wall(s). The exemplary dimensions of the spacer are calculated as the minimum necessary to ensure wall clearance in all applicable situations, with plain unadorned walls. If baseboard moldings are present at the base of the walls involved, this will only increase the wall clearance provided by the spacer, improving the function of the spacer.

The spacer may be of a material that can be cleaned easily, as it will be in close proximity to a trash can. For greater security of position, double-sided tape or adhesive hook and loop fastening tape can be used to secure the spacer to the floor, wall, and can. If the can shows a tendency to be bumped out of position and up over spacer 100, L-shaped angle brackets 140 may be added to the spacer top surface 130 along the edge facing the can (108 for round cans, 102 for rectangular or square cans) to increase the contact area with the can. These brackets prevent the spacer from slipping under the can. The brackets may be arranged to be removable so that the spacer can be used with no brackets, with the brackets on the curved side 108 for using the spacer with round or oval shaped cans, or on the long side 102 for use with a square or rectangular can, The shape and dimensions depicted here are arranged to allow for both single wall use and corner use, and allow one spacer to work in both situations. This same general design of spacer, however, allows different embodiments in which either length or width or both are increased, which will alter the range of suitability of the spacer for corner versus wall installations. Longer spacers allow larger cans to be used in corners as it increases the distance between the corner-abutting sides (104, 112 and 110, 106), and continue to work well in single wall installations, but make the spacer more visible as it protrudes beyond the can in both cases. Wider spacers also work better in corners as the spacer pushes the face that contacts the can further from the corner, but this may limit the spacer's usefulness in a single wall installation since it would push the can quite far out from the wall. The exemplary shape and dimensions described herein provide a useful compromise to accommodate all uses, hence this invention is a "universal" trash can spacer. However, it should be understood that other exemplary shapes and dimensions may be used to provide a "customized" fit for particular wall and trash can sizes and configurations.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A trash can spacer, comprising:

a six-sided rigid plate comprising:

a first straight side, a second concave side located opposite said first straight side and adapted to mate with a trash can having a corresponding convex shape, third and fourth sides adjacent to said first side, fifth and sixth sides adjacent to said second concave side, said third side being adjacent to said fifth side and said fourth side being adjacent to said sixth side, said third and fourth sides being offset 90 degrees relative to each other, and said fifth and sixth sides being offset 90 degrees relative to each other, wherein said second concave side corresponds to a portion of a circle having a diameter D, wherein said third and fourth sides are 0.267 times the length of said first straight side, said fifth and sixth sides are 0.567 times the length of said first straight side and said second concave side corresponds to a portion of a circle having a diameter of two times the length of said first straight side.

2. The trash can spacer of claim 1, wherein said first straight side is six inches long.

3. The trash can spacer of claim 2, having a thickness between 0.5 inches and 1.0 inches.

4. The trash can spacer of claim 1 having a thickness between 0.5 inches and 1.0 inches.

5. The trash can spacer of claim 1, further configured such that the spacer can be positioned against a single wall with either said second concave side or said first straight side located against the trash can, and with the opposite side against the wall.

6. The trash can spacer of claim 1, further configured such that said third and fourth or said fifth and sixth sides can be positioned against a 90 degree corner wall.

7. The trash can spacer of claim 1, further comprising at least one L bracket arranged to prevent the trash can spacer from sliding under a trash can.

8. The trash can spacer of claim 7, wherein said L bracket is flush against either said second concave side or said first straight side.

9. A trash can spacer, comprising:

a six-sided rigid plate comprising:

a first straight side, a second concave side located opposite said first straight side and adapted to mate with a trash can having a corresponding convex shape, third and fourth sides adjacent to said first side, fifth and sixth sides adjacent to said second concave side, said third side being adjacent to said fifth side and said fourth side being adjacent to said sixth side, said third and fourth sides being offset 90 degrees relative to each other, and said fifth and sixth sides being offset 90 degrees relative to each other, wherein said first straight side has a length equal to S, said third and fourth sides both have a length equal to 0.267 S, said fifth and sixth sides both have a length equal to 0.567 S, the second concave side is a portion of a circle having a diameter equal to 2 S, and the ends of the second concave side define a chord of the circle having a length of 0.567 S.

10. The trash can spacer of claim 9, further configured such that the spacer can be positioned against a single wall with either said second concave side or said first straight side located against the trash can, and with the opposite side against the wall.

11. The trash can spacer of claim 9, further configured such that said third and fourth or said fifth and sixth sides can be positioned against a 90 degree corner wall.

12. The trash can spacer of claim 9, further comprising at least one L bracket arranged to prevent the trash can spacer from sliding under a trash can.

13. The trash can spacer of claim 12, wherein said L bracket is flush against either said second concave side or said first straight side.

* * * * *